US005752142A

United States Patent [19]

Staples et al.

[11] Patent Number: 5,752,142

[45] Date of Patent: May 12, 1998

[54] METHOD AND APPARATUS FOR DEVELOPING ELECTROSTATIC IMAGES

[75] Inventors: Phillip Eric Staples, Warradale; Luis Lima-Marques, Blackwood, both of Australia

[73] Assignee: Watermark Imaging Ltd., Royston, England

[21] Appl. No.: 628,710

[22] PCT Filed: Oct. 13, 1994

[86] PCT No.: PCT/AU94/00623

§ 371 Date: Apr. 12, 1996

§ 102(e) Date: Apr. 12, 1996

[87] PCT Pub. No.: WO95/10800

PCT Pub. Date: Apr. 20, 1995

[30] Foreign Application Priority Data

Oct. 13, 1993 [AU] Australia ..... PM1789

[51] Int. Cl.[6] ..... G03G 15/10

[52] U.S. Cl. ..... 399/241; 347/55; 347/103; 399/239; 399/246; 430/117

[58] Field of Search ..... 399/237, 239, 399/240, 241, 246, 250; 347/55, 103, 105; 430/117

[56] References Cited

U.S. PATENT DOCUMENTS

| | | | |
|---|---|---|---|
| 2,690,394 | 9/1954 | Carlson . | |
| 3,212,916 | 10/1965 | Metcalfe et al. . | |
| 3,795,443 | 3/1974 | Heine-Geldern et al. . | |
| 3,943,268 | 3/1976 | Sato | 430/103 |
| 3,962,969 | 6/1976 | Watanabe et al. | 347/128 |
| 3,967,549 | 7/1976 | Thompson et al. | 347/125 |
| 3,972,305 | 8/1976 | Sato | 399/238 |
| 3,977,323 | 8/1976 | Pressman et al. | 347/55 |
| 3,983,801 | 10/1976 | Watanabe et al. | 347/125 |
| 4,013,004 | 3/1977 | Watanabe et al. | 347/124 |
| 4,013,356 | 3/1977 | Bestenreiner et al. | 399/246 |
| 4,110,029 | 8/1978 | Goshima et al. | 399/238 |

FOREIGN PATENT DOCUMENTS

| | | |
|---|---|---|
| 0 240 615 | 10/1987 | European Pat. Off. . |
| 35 35 025 | 4/1987 | Germany . |
| 987766 | 3/1965 | United Kingdom . |
| 994645 | 6/1965 | United Kingdom . |
| 1055290 | 1/1967 | United Kingdom . |

OTHER PUBLICATIONS

Patent Abstracts of Japan P325, p. 88, JP.A. 58–26841 (NEC Home Electronics K.K.), Aug. 31, 1984.

Patent Abstracts of Japan P264, p. 126, JP.A. 57–98477 (Konishiroku Shashin Kogyo K.K.), Dec. 12, 1983.

Patent Abstracts of Japan, vol. 009, no. 199 (P–380), Aug. 16, 1985 & JP 60 063574A (Kansai Nippon Denki KK), Apr. 11, 1985—Abstract.

Patent Abstracts of Japan, vol. 008, no. 068 (P–246), Mar. 30, 1984 & JP 58 215673 A (Konishiroku Shashin Kogyo KK), Dec. 5, 1983—Abstract.

*Primary Examiner*—Matthew S. Smith

*Attorney, Agent, or Firm*—Evenson, McKeown, Edwards & Lenahan, P.L.L.C.

[57] ABSTRACT

A method and apparatus to develop electrostatic images using a mist which is substantially water and a colorant. Mist is transported from a generation station to a development station via a development electrode. Unused mist may be recycled or extracted. The mist may be size classified before development so that a consistent and desired resolution is obtained. Classification by size may be achieved by passing the mist in an arcuate path from the generation station to the development station.

51 Claims, 3 Drawing Sheets

METHOD AND APPARATUS FOR DEVELOPING ELECTROSTATIC IMAGES

TECHNICAL FIELD

This invention relates to a method of and an apparatus for developing electrostatic images and particularly, to the development of such images by means of generated finite marking entities which are based on water and hence are environmentally friendly.

BACKGROUND ART

In the process of xerography, as disclosed in Carlson U.S. Pat. No. 2,297,691, issued Oct. 6, 1942, a xerographic plate comprising a layer of photoconductive insulating material on a conductive backing is given a uniform electric charge over its surface and is then exposed to the subject matter by conventional projection techniques. This exposure discharges the plate areas in accordance with the radiation intensity that reaches them, and thereby creates an electrostatic latent image on or in the photoconductive layer. Development of the latent image is usually effected with an electrostatically charged, finely-divided material such as an electroscopic powder that is brought into surface contact with the photoconductive layer and is held thereon electrostatically in a pattern corresponding to the electrostatic latent image. The developed electrostatic image is usually transferred to a support surface to which it is fixed by any suitable means. Where the electrostatic plate comprises a consumable material the developed image may be fixed directly.

Alternatively, the recording member may be a dielectric, as disclosed in Beaudet et al, U.S. Pat. No. 4,413,049 issued Nov. 1, 1983, where the dielectric recording member comprises sealed porous anodised aluminium. The recording member is charged with an electrostatic image, as so described in Fotland et al, U.S. Pat. No. 4,267,556 issued May 12, 1981, by a glow discharge electron source. Development of the so formed latent image is again effected with an electrostatically charged, finely-divided material such as an electroscopic powder that is brought into surface contact with the dielectric surface and is held thereon electrostatically in a pattern corresponding to the electrostatic latent image. The developed latent image is usually transferred to a support surface to which it is fixed by any suitable means. Where the dielectric recording member comprises a consumable material the developed image may be fixed directly. Various development systems are known in the art including cascade, powder cloud, liquid, magnetic, brush and the like, each of which employ electroscopic marking particles that are preferentially charged to a polarity. The charged particles are presented to the latent image to develop it. One common drawback of many of said development systems is dust generation which further requires the necessity to contain such dust.

In U.S. Pat. No. 2,690,394 to Carlson issued 28 Sept., 1954 there is described a system of electrostatic imaging which utilises an atomiser to produce a spray of droplets of a solvent. The droplets of solvent are charged by an electrode and then are drawn by means of a suction pump over a recording surface including an electrostatic image. Droplets of solvent are attracted by the oppositely charged image and deposit on the recording surface. The solvent is then transferred from the recording member to a sheet of paper and the paper then passes over a dye coated roller so that some of the dye is dissolved onto the paper to produce an image. Solvents proposed include high boiling point alcohols, cellosolve, toluene, cyclohexanol acetate and alcohol-water mixtures. It is also suggested that mixtures of solvent with an ink or dye can be atomised and also that the solvent can contain suspended pigments and binders. There is no disclosure, however, of a liquid system where the liquid is composed primarily of water.

It has been disclosed in Heine-Geldern et al, U.S. Pat. No. 3,795,443, issued Mar. 5, 1974, that some liquids not always characterised as being electrically resistive when generated into a fine mist in the vicinity of an electrostatic charge pattern will deposit selectively onto an electrostatic image. By chemically colouring the liquid, as by dyes and pigments the selective deposition produces an image reproduction which optionally can subsequently be transferred from or fixed directly on the image bearing surface. The development by this means is effected without utilising a carrier. Such a system experiences difficulty in developing solid areas without the benefit of external control means such as a development electrode.

Such methods as disclosed by Heine-Geldern et al and Carlson are characterised by inadequate development of the electrostatic image by mists such as ultrasonically generated liquid mists. Typically, only small amounts of colourant, be it dye stuff or pigment, deposit onto an electrostatic image on the recording member, be it photoconductor or dielectric, in a reasonable time, with respect to a practical device for office or industrial reproduction. Thus commercialisation of such an apparatus, as disclosed in Heine-Geldem et al and Carlson is seen as difficult with regard to the excessively long time that is required for development of the latent image, notwithstanding the low quantity of colouring material which as a result is deposited onto the recording member during such time.

Indoor air quality in offices and other areas where electrostatic image development is used can be seriously affected by hydrocarbon solvents which characterise many liquid development systems and dust which characterises many powder development systems. There is considerable advantage if an electrostatic image development system could be provided which uses water as the main carrier rather than a hydrocarbon solvent.

It is therefore an object of the invention to provide novel method for developing electrostatic latent images using water based development systems, including those pertaining to dielectric recording members.

It is a further object of the invention to provide a method by which generated liquid mists substantially of water are effective for developing electrostatic latent images by way of their movement between a development electrode and such latent images.

DISCLOSURE OF THE INVENTION

In accordance with this instant invention it has been discovered that some liquids characterised by being electrically conductive, such as water, when existing as a fine liquid mist generated by some mechanical means, can be transported to an electrostatic charge pattern such that the particles of the mist, will selectively, instantly deposit on such pattern thereby effecting rapid development. As the electrically conductive liquid may contain a colourant, either dye or pigment or a combination thereof the selective deposit thus produced can be subsequently transferred from or fixed to the image bearing surface, as an image reproduction.

Development by this method does not necessarily require the external charging of the liquid mist, however, it has been observed that charging of the liquid mist, enhances latent image development if the image is of opposite polarity, whilst a latent image of the same polarity, will actively repel said mist, further, a latent image containing both polarities will develop a deposit of excellent integrity, in that, so called background fog is eliminated.

Alternatively the invention provides a novel method in which generated liquid mists comprising substantially water are effective for developing electrostatic latent images by way of their movement between such latent image and a development electrode, which may be in the form of for instance a roller positioned and made to rotate, to aid and control the movement of said liquid mist, thereby enhancing the development of said latent image. Droplets of such a generated liquid mist may attain a charge, by some external means, and thereby are effective for developing electrostatic latent images. As is also known to those skilled in the art, the charge on the droplets of said liquid mist may be of either a positive or negative nature depending on the charge of the said latent image and the desired form of the so developed latent image. Alternatively, generated liquid mists, composed of, by and large, uncharged droplets, are effective for developing electrostatic latent images by way of their movement between such latent image and a development electrode or the like, positioned at some distance from the said latent image, as is known to those skilled in the art.

Alternatively the invention provides a novel method in which generated liquid mists, composed of charged droplets of water, are effective for developing electrostatic latent images by way of their movement between such latent image and a development electrode, in the form of a roller, positioned and made to rotate, to aid and control the movement of said liquid mist, thereby enhancing the development of said electrostatic latent image. The development electrode, may impart charge onto droplets of said liquid mist, as well as to aid and control the movement of such droplets in said liquid mist, thereby further enhancing the development of said electrostatic latent image.

In one form therefore the invention is said to reside in a method of developing a latent electrostatic image comprising the steps of;

(a) producing a mist from a liquid comprised substantially of water with a colourant incorporated therein such that the colourant is supported in the mist, (b) transporting the mist to a developer station, (c) passing the mist between a development electrode and a recording member incorporating the electrostatic image such that its direction of travel is substantially tangential or parallel to the recording member, (d) providing an electric field between the development electrode and the recording member, and (e) attracting the mist by means of the electric field to the electrostatic image to thereby develop the electrostatic image.

In an alternative form the invention may be said to reside in a method of developing a latent electrostatic image comprising-the steps of;

(a) producing a mist from a liquid comprised substantially of water with a colourant incorporated therein such that the colourant is supported in the mist at a production station, (b) transporting the mist to a developer station, (c) passing the mist between a development electrode and a recording member incorporating the electrostatic image at the development station such that the direction of travel of the mist is substantially tangential or parallel to the recording member, (d) providing an electric field between the development electrode and the recording member at the development station, and (e) attracting the mist by means of the electric field to the electrostatic image to instantaneously develop the electrostatic image.

In an alternative form the invention may be said to reside in an electrostatic image development arrangement comprising;

(a) means to produce a mist from a liquid comprised substantially of water with a colourant incorporated therein such that the colourant is supported in the mist, (b) means to transport the mist to a development station, (c) means to transport a recording member having a latent electrostatic image thereon through the development station, (d) the means to transport the mist further transporting the mist across the recording member between the recording member and an adjacent development electrode such that its direction of travel is substantially tangential or parallel to the recording member, and (e) means to apply a electric field between the development electrode and the recording member whereby the mist is attracted to the electrostatic image to thereby develop it.

In an alternative form the invention may be said to reside in an electrostatic image development arrangement for high speed printing comprising;

(a) mist production means to produce a mist from a liquid comprised substantially of water with a colourant incorporated therein such that the colourant is supported in the mist, (b) means to transport the mist to a development station in an arcuate path, (c) means to transport a recording member having a latent electrostatic image thereon through the development station, (d) the means to transport the mist further transporting the mist across the recording member between the recording member and an adjacent development electrode such that its direction of travel is substantially tangential to the recording member, and (e) means to apply a electric field between the development electrode and the recording member whereby the mist is attracted to the electrostatic image to instantaneously develop it.

In an alternative form the invention may be said to reside in an electrostatic image development arrangement for high speed printing comprising;

(a) mist production means to produce a mist from a liquid comprised substantially of water with a colourant incorporated therein such that the colourant is supported in the mist, (b) means to transport the mist to a development station in an arcuate path, (c) means to transport a recording member having a latent electrostatic image thereon through the development station, (d) the means to transport the mist further transporting the mist across the recording member between the recording member and an adjacent development electrode such that its direction of travel is substantially parallel to the recording member, and (e) means to apply a electric field between the development electrode and the recording member whereby the mist is attracted to the electrostatic image to instantaneously develop it.

The colourant supported in the mist may also include bactericides, humectants, dispersants, fixing agents, binders and charge control agents such that all of these may be supported in the mist and be carried with the mist to deposit on the electrostatic image.

In a preferred embodiment of the invention the droplets of the generated liquid mists, effective for developing electrostatic latent images may contain a colourant in the form of a dye stuff or mixture of dye stuffs, a pigment or mixture of pigments or mixtures of dyestuffs and pigments so as to render the said latent electrostatic image visible when deposited thereon. Alternatively the liquid may include a polymeric material which upon deposition onto the recording member surface may be fixed such that the recording member may be used as a plate for offset printing without an image being visible thereon.

The mist may be transported in an arcuate path between the mist production station and the development station. In one embodiment the arcuate path may be defined between two curved plates. The flow of mist in the arcuate path may be caused by the spray generation of the mist or it my be induced by forced removal of mist beyond the development station. Alternatively the arcuate path may be provided by the mist travelling around part of the surface of a drum which comprises the development electrode.

Preferably the development electrode is a drum adapted to rotate and the mist is carried around adjacent the periphery of the drum from a mist generation station to the development station in a flow of air caused by the movement of the drum. The drum may have a surface which has sufficient surface roughness to carry the mist between the point of generation and the development station. The surface of the drum may be aluminium with a grained aluminium oxide coating so that the surface does not discharge the charged mist. The development electrode drum may be rotated at a speed to give a surface speed which is considerably higher than the surface speed of the recording member through the development station. The development electrode drum may be rotated so as to give a surface speed of from 1 to 10 meters per second.

The means to produce a mist of droplets may produce droplets having a size range of from less than 0.1μ to greater than 100μ. It is desirable for good resolution of a developed image that the droplets not have too wide a size range. If the droplets all have the same charge and too wide a size range then they will give an uneven image when deposited onto the recording member. One preferred method of selecting mist droplets of a desired size is to transport them in an arcuate path between the production station and the development station so that the droplets which are larger and hence more massive will move by their momentum towards the outer curve of the arcuate path and may be removed by some form of baffle. Droplets which are smaller and hence lighter will not move so far away from the drum and may not be close enough to the recording member at the development station to take part in the development of the image. Intermediate sizes of droplets may be selected for development of the electrostatic image There may be a shroud surrounding but spaced from the periphery of the drum. The mist may be retained in the annular space between the shroud and the periphery of the drum by means of an electric field between these members counteracting the motion of the droplets of the mist between the development electrode and the shroud due to their momentum. The momentum of the droplets provides a substantially tangential motion at any point thus tending to move them in a straight line which will move them nearer the shroud.

The action of the classification of the mist droplets may be enhanced or achieved by the use of an electric field between the development electrode and the shroud. This can be achieved by applying different voltages to the development drum and the shroud. The development electrode may have a polarity opposite to that of the mist droplets so that they are attracted to the development electrode. Movement of the droplets in the arcuate path, however, will provide a momentum on the droplets tending to move them away from the development electrode. For droplets of a desired selected charge and mass the force of electrostatic attraction and the motion due to their momentum will balance each other and no net motion of the droplets relative to the drum surface will occur. Where the size and hence mass is high compared to the charge the motion due to their momentum will overcome the electrostatic force and droplets will impinge onto the shroud. Suitable collection means may be provided to remove such impinged droplets. Where the size is smaller then the electrostatic force may be higher than the motion due to their momentum and such droplets will be attracted to the drum and not take part in the development process.

Droplets may be classified, therefore, by size and speed of travel in the arcuate path such as by selection of the surface speed of the development electrode drum. Further classification may be achieved by the voltage difference between the shroud and the development electrode. It may be desirable to use both forms of classification as the use of electric field classification only may not remove larger multiple charged droplets.

Classification of droplets according to size may not be necessary if a method of droplet formation is used which does not give a wide range of droplet sizes.

The recording member may be another drum or a surface on another drum and hence the development station may be the region of closest proximity between the two drums. Alternatively the recording member may be a planar surface transported through the development station. Recording members to which the present invention is applicable may include a drum with a photoconductive surface, a drum with a dielectric surface or a consumable material such as paper or an offset printing plate on which the image is developed.

The mist may be generated by a variety of means, including the use of ultrasonic transducers, high pressure spray and the like. Droplet size of the order of 0.1 to 100 microns are useable; 0.5 to 5.0 microns are preferred.

The mist may be charged either to a positive or negative charge either at or immediately after generation.

Unused mist may be extracted when the mist has passed the development station and this may be done for instance by a vacuum extractor.

Alternatively the mist may be reused by recirculating the mist on the development drum past the mist generation to again enter the development station. There may be provided an auxiliary fan or other air circulating means to assist with recirculating of the mist the amount of recirculation of mist may be controlled to give a steady flow of mist or a desired mist density through the development station.

In an alternative form the invention may be said to reside in a method of developing a latent electrostatic image for high speed printing comprising the steps of;

(a) producing a mist from a liquid comprised substantially of water with a colourant incorporated therein such that the colourant is supported in the mist, (b) transporting the mist to a developer station in an arcuate path, (c) passing the mist between a development electrode and a recording member having a surface incorporating the electrostatic image at the development station such that the direction of travel of the mist is substantially parallel to the surface of the recording member, (d) providing an electric field between the development electrode and the recording member, (e) attracting the mist by means of the electric field to the electrostatic image to instantaneously develop the electrostatic image, and (f) extracting the residual unused mist from the development station.

In an alternative form the invention may be said to reside in an electrostatic image development arrangement for high speed printing comprising;

(a) mist production means to produce a mist from a liquid comprised substantially of water with a colourant incorporated therein such that the colourant is supported in the mist, (b) means to transport the mist in an arcuate path to a development station, (c) classification means to select mist droplets of a selected size range and to discard droplets above and below the selected size range, (d) means to transport a recording member having a latent electrostatic image thereon through the development station, (e) the means to transport the mist further transporting the mist of the selected size range across the recording member between the recording member and an adjacent development electrode such that its direction of travel is substantially parallel or tangential to the recording member, (f) means to apply an electric field between the development electrode and the recording member whereby the mist is attracted to the electrostatic image to instantaneously develop it, and (g) means to extract unused mist from the development station.

In an alternative form the invention may be said to reside in a method of developing an electrostatic image using a mist comprising substantially of water with a colourant incorporated therein such that the colourant is supported in the mist including the step of classifying the mist into a selected droplet size range before development of the image.

In an alternative form the invention may be said to reside in an electrostatic image development arrangement for high speed printing including mist production means to produce a mist from a liquid comprised substantially of water with a colourant incorporated therein such that the colourant is supported in the mist and classification means to separate droplets from the mist which are above or below a selected size range before development of an electrostatic image.

According to this invention a high speed printer may be one adapted to print an image onto a recording member such as a paper at speed of up to a half or one meter per second or up to 100 pages per minute.

This then generally describes the invention but to assist with understanding of the various features, advantages and limitations of the invention reference will now be made to the following description and drawings of preferred embodiments of the invention.

BEST MODE FOR CARRYING OUT THE INVENTION

Figure 1:
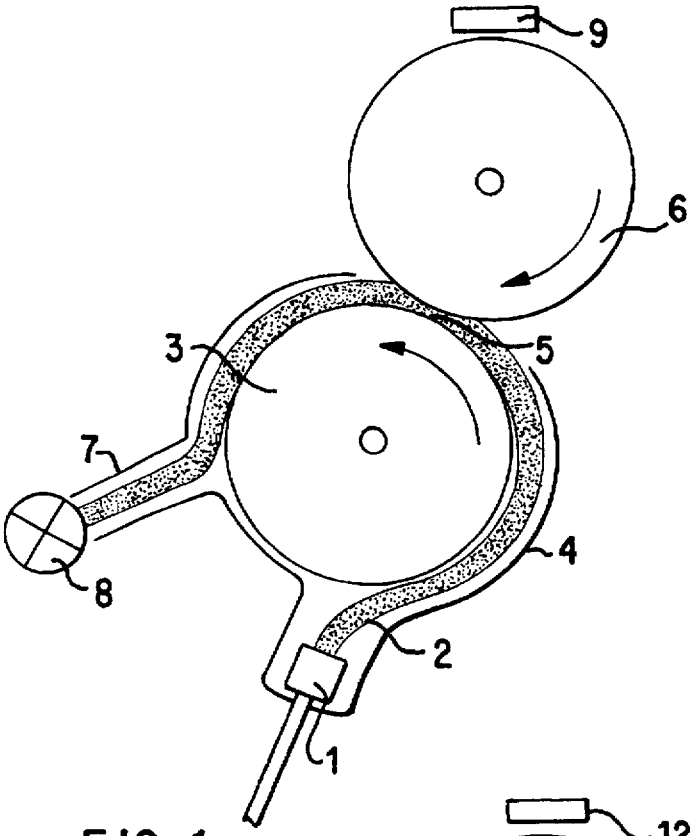
FIG. 1 shows a schematic first embodiment of an apparatus for developing an electrostatic image according to this invention.

FIG. 1 shows an embodiment of the present invention in schematic form. The positioning of the various components does not necessarily indicate the desired positions in a production model of such a machine.

The apparatus for developing an electrostatic image comprises a water mist generation device 1 adapted to direct mist into the arcuate space 2 between a development drum 3 and a shroud 4. The development drum 3 is adapted to rotate as indicated by the arrow so as to draw the mist around in the arcuate path. The mist is transported to a development station 5 which is the region of nearest proximity between the development drum 3 and a recording drum 6. Unused mist is carried further around the development drum 3 to an extraction duct 7. Extraction of unused mist is enhanced by an extraction fan 8. The mist may be condensed and the waste liquid passed to storage (not shown) or recycled to the water mist generation device. The recording drum may have a recording member on its surface upon which an electrostatic image is produced at imaging station 9 and which is then rotated in the direction of the arrow to the development station for instantaneous development of the image. The imaging station 9 may include means to charge the recording member and form the required electric charge pattern as is well known in the art. Deposited image fixing or subsequent transferral of the image (not shown) after the development station will be well understood by those skilled in the art.

Figure 2:
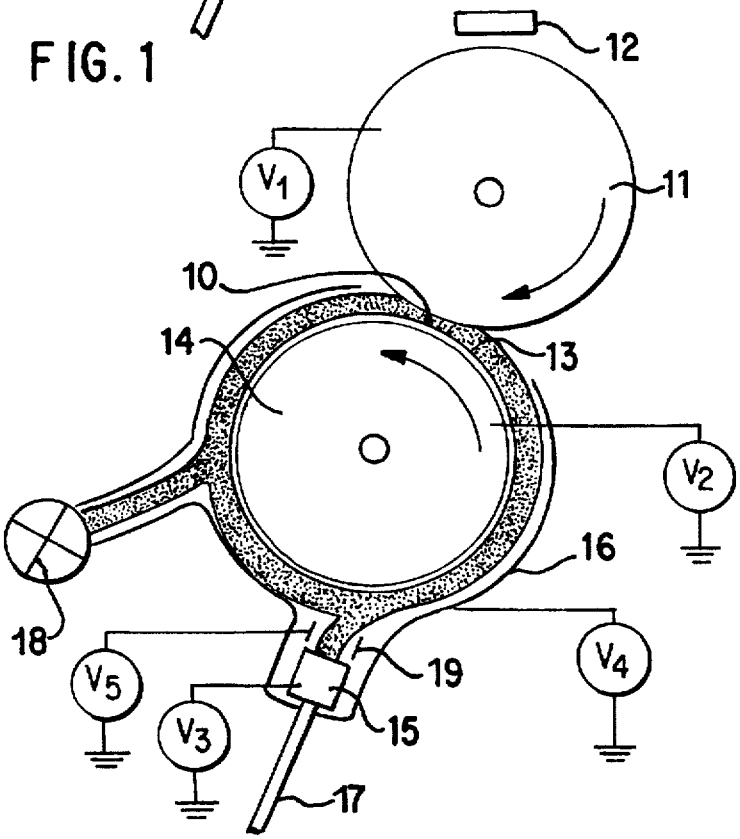
FIG. 2 shows a schematic second embodiment of an apparatus for developing an electrostatic image according to this invention.

FIG. 2 shows a further embodiment of this instant invention. A rotating recording member 11 at a potential $V_1$ being of dielectric nature, has an electric charge pattern deposited onto the surface of said recording member by an array of computer controlled glow discharge electron sources 12. The recording member is rotated so that the electric charge pattern is brought into contact with a liquid mist 13 at a development station 10. The liquid mist 13 is transported to the development station by way of a cylindrical development electrode 14, to which a potential $V_2$ is applied. The liquid mist is made to impinge upon the cylindrical development electrode 14 by an ultrasonic atomiser 15 at potential $V_3$ which generates the mist and passes it through a charging tunnel 19 which is at a potential $V_5$ and onto the development electrode 14. The ink is supplied by tube 17 to the atomiser 15 and the position of the atomiser 15 is such that the particles of the mist are attracted to the development electrode 14 and then to the latent image electric charge pattern on said recording member 11. The mist is contained by a shroud 16 at potential $V_4$ as it is transported to the development station, with the excess droplets of said liquid mist being removed by vacuum suction means 18 after the development station.

The mist as it travels around the development electrode 14 travels in an arcuate path so that the motion and momentum of the droplets tends to cause the droplets to travel tangentially in a straight line away from the development electrode. This motion due to momentum is balanced by an electric field force generated by the difference in the voltages $V_4$ and $V_2$ so that droplets which have a selected charge/mass ratio will be transported to the development station 10. Droplets with a higher charge/mass ratio will be drawn to the development electrode 14 and those with a lower charge/mass ratio will move out to the shroud 16. This provides classification of droplets to a selected size and hence will assist in providing an even resolution on the developed image.

Figure 3:
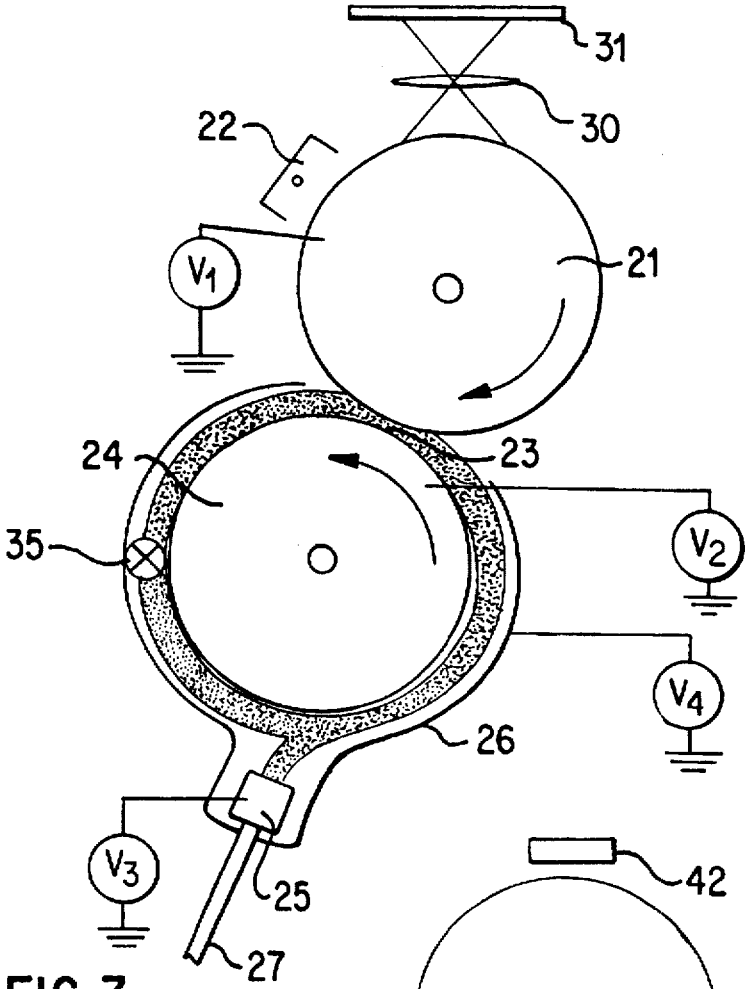
FIG. 3 shows a schematic third embodiment of an apparatus for developing an electrostatic image according to this invention.

FIG. 3 shows another embodiment of this instant invention. A rotating electrophotographic recording member 21 at a potential $V_1$ is uniformly charged by a corona 22, exposed to reflected light through a lens 30 from an illuminated copyboard 31, thereby selectively discharging said recording member in all areas subjected to light and so forming a latent image. The recording member 21 is brought into contact with the liquid mist 23, by way of a rotating cylindrical development electrode 24, to which a potential $V_2$ is applied. The liquid mist is generated by an ultrasonic atomiser 25 which is at a potential $V_3$ which is supplied with ink by tube 27. The position of the atomiser 25 is selected such that the droplets of said mist are attracted to said developing electrode 24 and then to the latent image on said recording member. The mist is contained by shroud 26, at potential $V_4$. Excess particles of the liquid mist are carried around by the drum 24 to a centrifugal fan 35 which assists with recirculation of the mist back to the development station thereby providing for recycling of the mist. This allows a closed or substantially closed system thereby giving minimum wastage of consumables and a system which does least damage to indoor air quality.

Once again as the mist travels around the development electrode 24 it travels in an arcuate path defined on the outside of the curve by the shroud 26 so that the momentum of the droplets in the mist tends to move them outwards. This momentum is balanced by an electric field force generated by the difference in the voltages $V_4$ and $V_2$ so that droplets which have a selected charge/mass ratio will be transported to the development station 23. Droplets with a higher charge/mass ratio will be drawn to the development electrode 24 and those with a lower charge/mass ratio will move out to the shroud 26. This provides classification of droplets to a selected size and hence will assist in providing an even resolution on the developed image.

Figure 4:
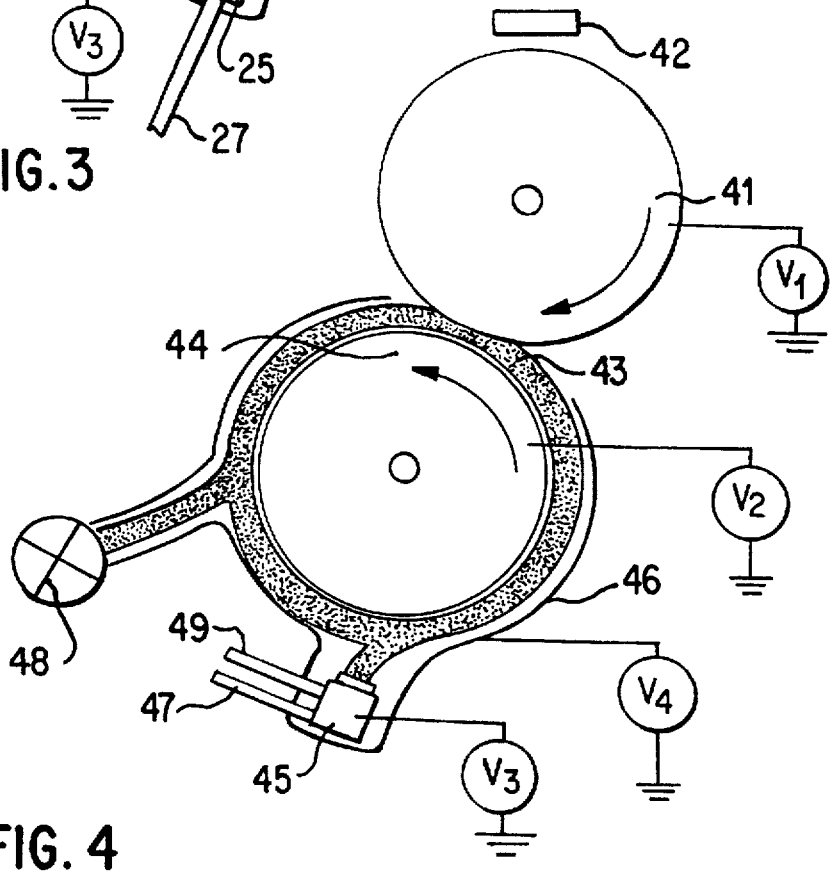
FIG. 4 shows a schematic fourth embodiment of an apparatus for developing an electrostatic image according to this invention.

FIG. 4 shows yet another embodiment of this instant invention. A rotating recording member 41, at a potential $V_1$ being of dielectric nature, has an electric charge pattern deposited onto the surface of said recording member by an array of computer controlled glow discharge electron sources 42. The recording member is brought into contact with the liquid mist 43, by way of a cylindrical development electrode 44, to which a potential $V_2$ is applied and onto which the said liquid mist is made to impinge by a pressure spray 45, which is at a potential $V_3$. The ink is supplied by a pump (not shown) through a tube 47 and the air pressure by a compressor (not shown) through line 49. The position of said pressure spray is selected such that the particles of said mist are attracted to said developing electrode 44 and then to the latent image on said recording member 41. The said mist is contained by shroud 46, at potential $V_4$, with the excess droplets of said liquid mist being removed by vacuum suction means 48. In this embodiment a degree of recycling is used. The recycling can be controlled by the use of the vacuum suction means 48.

Figure 5:
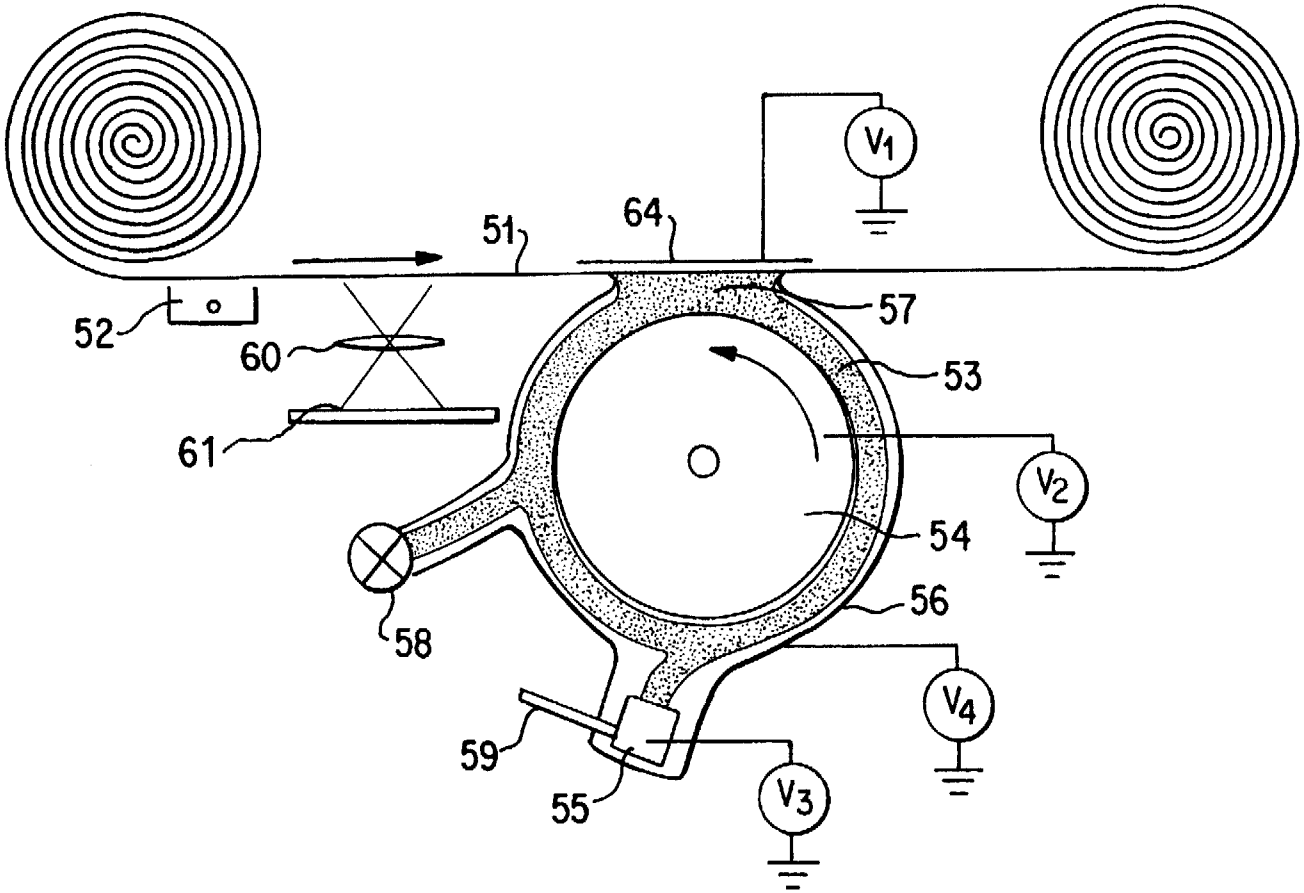
FIG. 5 shows an alternative embodiment of apparatus for effecting development in accordance with this invention.

FIG. 5 shows yet another embodiment of this instant invention. An electrophotographic plate 51, being of finite length or continuous and which may be of the consumable type, at a potential $V_1$, is uniformly charged by a corona 52, exposed to reflected light through a lens 60, from a illuminated copyboard 61, thereby selectively discharging said recording member in all areas subjected to light and so forming a latent image. The recording member is brought into contact with the liquid mist 53 at a development station 57. The liquid mist 53 is transported to the development station 57 by way of a cylindrical development electrode 54, to which a potential $V_2$ is applied and onto which the liquid mist is made to impinge after being generated by an ultrasonic atomiser 55, which is at a potential $V_3$. The ink from which the mist is generated is supplied by tube 59. The position of the atomiser is such that the particles of said mist are attracted to said developing electrode 54 and then to the latent image on said electrophotographic plate 51 by being contained by shroud 56, at potential $V_4$. The excess droplets of said liquid mist are removed by vacuum suction means 58. In this embodiment a degree of recycling is used. The recycling can be controlled by the use of the vacuum suction means 58.

The droplets of the liquid mist are preferably of such dimension that they exhibit a volume resistivity and dielectric constant which in air, does not substantially reduce said latent image electrostatic field. Mist may be generated by a variety of means, including the use of ultrasonic transducers, high pressure spray and the like. Droplet size of the order of 0.1 to 100 microns are useable, 0.5 to 5.0 microns are preferred. The droplets may be charged but this is by no means an essential requirement of this invention. However, it has been found that image quality is a function of both the droplet charge distribution and droplet size distribution. As those skilled in the art would recognise, a narrow distribution of droplet charge, including the condition of nil charge, yields superior image quality than that obtained with a wide distribution of said droplet charge. Likewise with respect to droplet size, a narrow distribution is associated with excellent image quality, especially with regard to resolution and background fog. Fast development of the latent image has been found to be effected when both the droplet size distribution and charge distribution is narrow.

The developing electrode, as described in the above embodiments, is in the form of a cylinder or roller which is effective in transporting the droplets of mist to the recording member such that instant development occurs. As is known to those skilled in the art, a development electrode enhances the electrostatic field emanating from a recording member, thus effecting improved so called fill-in of the developed image. In this invention, the development electrode acts both to aid the deposition of the marking particles in the form of droplets and to transport the mist of said droplets to the latent image such that instant development is expedited. It has been found that the surface speed of said development electrode cylinder affects the efficiency of the development of the latent image. For instant development of said recording member, surface speeds of 0.1 to 10 meters per second are suitable but 1 to 5 meters per second are preferred. Other characteristics of said development electrode which affect development include surface topology, surface and volume resistivity. It has been found that a grained metal surface is preferred for instant development of the latent image but this perception should not be interpreted as restricting the scope of this instant invention. By applying appropriate electric potentials $V_1$ and $V_2$ during latent image development, high optical image density with very low background fog can be easily achieved. In the preferred embodiment of this invention the development electrode is at ground potential with $V_1$ between 50 to 100 volts, although image deposition has been observed with voltages in the range 0 to 500 volts.

The droplets constituting the mist may acquire a charge by some external means which may include the employment of a charge tunnel 19 as in FIG. 2 or the like but notwithstanding inductive charging by the application of appropriate potential difference between the atomiser or spray nozzle 45 and the developing electrode 44 (FIG. 4), or likewise between the envelope 16, 26, 46, 56 and the developing electrode 14, 24, 44, 54 or indeed between the recording member 11, 21, 41, 51 and the developing electrode 14, 24, 44, 54 The preferred embodiment is with a potential applied between the pressure spray nozzle and the developing electrode, where the magnitude of this potential is between 500 and 5000 volts, with the preferred range being between 1000 and 2000 volts. Nevertheless high optical density images have been observed with no external charging of the droplets in the said mist.

The position of the vacuum suction means, envelope and developing electrode should be juxtaposed such that an appropriate flow of mist containing droplets is rendered at the latent image to expedite instant development of said latent image. The positions shown in the various embodiments illustrated are schematic only.

The intensity of the suction means should be such that the mist of droplets can fully develop the latent image to a high optical density, without depositing in the non-image or background areas so as to produce background fog. As will be known to those skilled in the art, the vacuum suction means could be replaced by a positive displacement system such as a fan or the like, so as to propel the mist of droplets to the latent image. This arrangement has certain advantages with respect to recirculating the mist of droplets thus producing a so called closed developing system, eminently suitable with respect to an environment where indoor air quality standards must be complied with.

The following examples are provided by way of illustration of several embodiments of the invention.

EXAMPLE 1

A dielectric drum comprising of a sealed porous anodised aluminium surface was used in an apparatus as disclosed in FIG. 2.

The dielectric recording member was rotated while an electric charge pattern was deposited onto the surface of said recording member by an array of computer controlled glow discharge electron sources.

The recording member at ground potential was rotated at 0.2 $ms^{-1}$ such that the electric charge pattern was brought into contact with the liquid mist.

The liquid mist being generated by an ultrasonic atomiser at ground potential and through a charging tunnel at a potential of −2000 volts.

The mist was contained by the shroud which was at 100 volts potential.

The liquid mist was transported to the development station by way of the cylindrical development electrode rotating at 2.0 $ms^{-1}$ and which was at 150 volts potential.

An image of good resolution and density was obtained by this method.

EXAMPLE 2

A dielectric drum comprising of a DuPont Teflon FEP film coated surface was used in an apparatus as disclosed in FIG. 2.

The dielectric recording member was rotated while an electric charge pattern was deposited onto the surface of said recording member by an array of computer controlled glow discharge electron sources.

The recording member at 50 volts potential was rotated at 0.2 $ms^{-1}$ such that the electric charge pattern was brought into contact with the liquid mist.

The liquid mist was generated by an ultrasonic atomizer at ground potential and through a charging tunnel at a potential of −2000 volts.

The mist was contained by the shroud which was at ground potential.

The liquid mist was transported to the development station by way of the cylindrical development electrode rotating at 2.0 $ms^{-1}$ and which was at ground potential.

A dense image of good resolution was obtained by this method.

EXAMPLE 3

A dielectric drum comprising of Tetlight TCF polyester film by Oike & Co. Ltd. was used in an apparatus as disclosed in FIG. 2.

The dielectric recording member was rotated while an electric charge pattern was deposited onto the surface of said recording member by an array of computer controlled glow discharge electron sources.

The recording member at 0 volts potential was rotated at 0.2 $ms^{-1}$ such that the electric charge pattern was brought into contact with the liquid mist.

The liquid mist being generated by an ultrasonic atomizer at ground potential and through a charging tunnel at a potential of −2000 volts.

The mist was contained by the shroud which was at −100 volts potential.

An image of very good resolution was obtained by this method.

EXAMPLE 4

An OPC drum was used in an apparatus as disclosed in FIG. 3.

The recording member was rotated while being uniformly charged by a corona, exposed to reflected light through a lens from an illuminated copyboard, thereby selectively discharging said recording member in all areas subjected to light and so forming a latent image.

The recording member at ground potential was rotated at 0.2 $ms^{-1}$ such that the latent image was brought into contact with the liquid mist.

The liquid mist being generated by an ultrasonic atomizer at a potential of 2000 volts.

The mist was contained by the shroud which was at ground potential.

The liquid mist was transported to the development station by way of the cylindrical development electrode rotating at 2.0 $ms^{-1}$ and which was at ground potential.

An image of good resolution and density was obtained by this method.

EXAMPLE 5

A dielectric drum comprising of Tetlight TCF polyester film by Oike & Co. Ltd was used in an apparatus as disclosed in FIG. 4.

The dielectric recording member was rotated while an electric charge pattern was deposited onto the surface of said recording member by an array of computer controlled glow discharge electron sources.

The recording member at −100 volts potential was rotated by 0.5 $ms^{-1}$ such that the electric charge pattern was brought into contact with the liquid mist.

The liquid mist being generated by a 150 μm nozzle pressure spray of 75 kPa at 3000 volts potential.

The mist was contained by the shroud which was at 200 volts potential.

The liquid mist was transported to the development station by way of the cylindrical development electrode rotating at 5.0 $ms^{-1}$ and which was at 300 volts potential.

An image of good density and resolution was obtained by this method.

EXAMPLE 6

A dielectric drum comprising of Tetlight TCF polyester film by Oike & Co. Ltd was used in an apparatus as disclosed in FIG. 4.

The dielectric recording member was rotated while an electric charge pattern was deposited onto the surface of said recording member by an array of computer controlled glow discharge electron sources.

The recording member at −100 volts potential was rotated at 0.5 $ms^{-1}$ such that the electric charge pattern was brought into contact with the liquid mist.

The liquid mist being generated by a 150 μm nozzle pressure spray of 150 kPa at 3000 volts potential.

The mist was contained by the shroud which was at 200 volts potential.

The liquid mist was transported to the development station by way of the cylindrical development electrode rotating at 5.0 $ms^{-1}$ and which was at 300 volts potential.

An image of high density and good resolution was obtained by this method.

EXAMPLE 7

A zinc oxide electrophotographic plate was used in an apparatus as disclosed in FIG. 5.

The recording member was rotated while being uniformly charged by a corona, exposed to reflected light through a lens from an illuminated copyboard, thereby selectively discharging said recording member in all areas subjected to light and so forming a latent image.

The recording member at −50 volts potential was rotated at 0.3 $ms^{-1}$ such that the latent image was brought into contact with the liquid mist.

The liquid mist being generated by an ultrasonic atomizer at 3000 volts potential.

The mist was contained by the shroud which was at 100 volts potential.

The liquid mist was transported to the development station by way of the cylindrical development electrode rotating at 5.0 $ms^{-1}$ and which was at 150 volts potential.

An image of good density and resolution was obtained by this method.

Throughout this specification and the claims that follow unless the context requires otherwise, the words 'comprise' and 'include' and variations such as 'comprising' and 'including' will be understood to imply the inclusion of a stated integer or group of integers but not the exclusion of any other integer or group of integers.

We claim:

1. A method of developing a latent electrostatic image comprising the steps of;

(a) producing a mist from a liquid comprised substantially of water with a colourant incorporated therein such that the colourant is supported in the mist, (b) transporting the mist to a developer station in an arcuate path, (c) passing the mist between a development electrode and a recording member incorporating the electrostatic image such that its direction of travel is substantially tangential or parallel to the recording member, (d) providing an electric field between the development electrode and the recording member, and (e) attracting the mist by means of the electric field to the electrostatic image to thereby develop the electrostatic image.

2. A method of developing a latent electrostatic image comprising the steps of;

(a) producing a mist from a liquid comprised substantially of water with a colourant incorporated therein such that the colourant is supported in the mist at a production station, (b) transporting the mist to a development station in an arcuate path, (c) passing the mist between a development electrode and a recording member incorporating the electrostatic image at the development station such that the direction of travel of the mist is substantially tangential or parallel to the recording member, (d) providing an electric field between the development electrode and the recording member at the development station, and (e) attracting the mist by means of the electric field to the electrostatic image to instantaneously develop the electrostatic image.

3. A method as in claim 2 further comprising classifying the mist into a selected size range before transporting it to the development station.

4. A method as in claim 2 wherein the development electrode is a first drum adapted to rotate and the mist is carried in the arcuate path around the periphery of the drum from the production station to the development station.

5. A method as in claim 4 wherein the first drum has a surface which has sufficient surface roughness to assist with carrying the mist between the production station and the development station.

6. A method as in claim 5 wherein the first drum is rotated at a speed to give a surface speed of from 1 to 10 meters per second.

7. A method as in claim 4 wherein the first drum has a surface of aluminium with a grained aluminium oxide coating such that the surface does not discharge the mist.

8. A method as in claim 4 wherein the first drum is rotated at a speed to give a surface speed which is considerably higher than the surface speed of the recording member through the development station.

9. A method as in claim 2 wherein the recording member is a drum or mounted onto a drum and the development station is the region of closest proximity between the second drum and the development electrode.

10. A method as in claim 9 wherein the drum has a photoconductive surface.

11. A method as in claim 9 wherein the drum has a dielectric surface.

12. A method as in claim 2 wherein the recording member includes a planar surface which is adapted to be transported through the development station.

13. A method as in claim 2 wherein the recording member is a consumable material comprising paper or an offset printing plate on which the image is developed.

14. A method as in claim 2 further including a shroud surrounding but spaced from the periphery of the development electrode and wherein the mist is retained in the space between the shroud and the development electrode by means of an electric field between these members counteracting the momentum of the droplets tending to move them away from the development electrode caused by the arcuate path of the mist.

15. A method as in claim 2 wherein the mist is generated by ultrasonic transducers or high pressure spray.

16. A method as in claim 2 wherein the mist has droplet size of from 0.1 to 100 microns.

17. A method as in claim 16 wherein the mist has a droplet size from 0.5 to 5 microns.

18. A method as in claim 2 wherein the mist is charged either to a positive or negative charge either at or immediately after the time of production.

19. A method as in claim 2 wherein unused mist is extracted when the mist has passed the development station.

20. A method as in claim 2 wherein the mist is reused by recirculating the mist to the development station.

21. A method as in claim 2 wherein the colourant comprises a dye stuff or mixture of dye stuffs, a pigment or mixture of pigments or a mixtures of dyestuffs and pigments so as to render the said latent electrostatic image visible when deposited thereon.

22. A method as in claim 2 wherein the colourant comprises a polymeric material which upon deposition onto the recording member surface may be fixed such that the recording member may be used as a plate for offset printing without an image being visible thereon.

23. A method as in claim 22 wherein the colourant further includes bactericides, humectants, dispersants, fixing agents, binders and charge control agents such that all of these may be supported in the mist and be carried with the mist to deposit on the electrostatic image.

24. A method of developing a latent electrostatic image for high speed printing comprising the steps of;

(a) producing a mist from a liquid comprised substantially of water with a colourant incorporated therein such that the colourant is supported in the mist, (b) transporting the mist to a development station in an arcuate path, (c) passing the mist between a development electrode and a recording member having a surface incorporating the electrostatic image at the development station such that the direction of travel of the mist is substantially parallel or tangential to the surface of the recording member, (d) providing an electric field between the development electrode and the recording member, (e) attracting the mist by means of the electric field to the electrostatic image to instantaneously develop the electrostatic image, and (f) extracting residual unused mist from the development station.

25. An electrostatic image development arrangement comprising;

(a) means to produce a mist from a liquid comprised substantially of water with a colourant incorporated therein such that the colourant is supported in the mist, (b) means to transport the mist to a development station, (c) means to transport a recording member having a latent electrostatic image thereon through the development station in an arcuate path, (d) the means to transport the mist further transporting the mist across the recording member between the recording member and an adjacent development electrode such that its direction of travel is substantially tangential or parallel to the recording member, and (e) means to apply an electric field between the development electrode and the recording member whereby the mist is attracted to the electrostatic image to thereby develop it.

26. An electrostatic image development arrangement for high speed printing comprising;

(a) mist production means to produce a mist from a liquid comprised substantially of water with a colourant incorporated therein such that the colourant is supported in the mist, (b) means to transport the mist to a development station in an arcuate path, (c) means to transport a recording member having a latent electrostatic image thereon through the development station, (d) the means to transport the mist further transporting the mist across the recording member between the recording member and an adjacent development electrode such that its direction of travel is substantially parallel to the recording member, and (e) means to apply an electric field between the development electrode and the recording member whereby the mist is attracted to the electrostatic image to instantaneously develop it.

27. An electrostatic image development arrangement as in claim 26 wherein the recording member includes a planar surface which is adapted to be transported through the development station.

28. An electrostatic image development arrangement for high speed printing comprising;

(a) mist production means to produce a mist from a liquid comprised substantially of water with a colourant incorporated therein such that the colourant is supported in the mist, (b) means to transport the mist to a development station in an arcuate path, (c) means to transport a recording member having a latent electrostatic image thereon through the development station, (d) the means to transport the mist further transporting the mist across the recording member between the recording member and an adjacent development electrode such that its direction of travel is substantially tangential to the recording member, and (e) means to apply a electric field between the development electrode and the recording member whereby the mist is attracted to the electrostatic image to instantaneously develop it.

29. An electrostatic image development arrangement as in claim 28 wherein the development electrode is a first drum adapted to rotate and to carry the mist in the arcuate path around the periphery of the first drum from the mist production means to the development station.

30. An electrostatic image development arrangement as in claim 29 wherein the first drum has a surface which has sufficient surface roughness to assist with carrying the mist between the mist production means and the development station.

31. An electrostatic image development arrangement as in claim 29 wherein the drum has a surface of aluminium with a grained aluminium oxide coating such that the surface does not discharge the charged mist.

32. An electrostatic image development arrangement as in claim 29 wherein the first drum is rotated at a speed to give a surface speed which is considerably higher than the surface speed of the recording member through the development station.

33. An electrostatic image development arrangement as in claim 29 wherein the first drum is rotated so as to give a surface speed of from 1 to 10 meters per second.

34. An electrostatic image development arrangement as in claim 28 wherein the recording member is a drum or mounted onto a drum and the development station is the region of closest proximity between the drum and the development electrode.

35. An electrostatic image development arrangement as in claim 34 wherein the drum has a photoconductive surface.

36. An electrostatic image development arrangement as in claim 34 wherein the drum has a dielectric surface.

37. An electrostatic image development arrangement as in claim 28 wherein the recording member is a consumable material comprising paper or an offset printing plate on which the image is developed.

38. An electrostatic image development arrangement as in claim 28 further including a shroud surrounding but spaced from the periphery of the development electrode, the mist being retained in the space between the shroud and the development electrode by means of an electric field between these members counteracting the momentum of the mist droplets travelling in the arcuate path.

39. An electrostatic image development arrangement as in claim 28 wherein the means to produce a mist is an ultrasonic transducer or a high pressure spray.

40. An electrostatic image development arrangement as in claim 28 wherein the mist has a droplet size of from 0.1 to 100 microns and.

41. An electrostatic image development arrangement as in claim 40 wherein the mist has a droplet size of from 0.5 to 5 microns.

42. An electrostatic image development arrangement as in claim 28 including means to charge the mist to a positive or negative charge either at or immediately after the time of production.

43. An electrostatic image development arrangement as in claim 28 further including an extractor to extract unused mist when the mist has passed the development station.

44. An electrostatic image development arrangement as in claim 28 further including a fan means to recycle the mist around the development drum.

45. An electrostatic image development arrangement as in claim 28 wherein the colourant comprises a dye stuff or mixture of dye stuffs, a pigment or mixture of pigments or a mixtures of dyestuffs and pigments so as to render the said latent electrostatic image visible when deposited thereon.

46. An electrostatic image development arrangement as in claim 28 wherein the colourant comprises a polymeric material which upon deposition onto the recording member surface may be fixed such that the recording member may be used as a plate for offset printing without an image being visible thereon.

47. An electrostatic image development arrangement as in claim 46 wherein the colourant further includes bactericides, humectants, dispersants, fixing agents, binders and charge control agents such that all of these may be supported in the mist and be carried with the mist to deposit on the electrostatic image.

48. An electrostatic image development arrangement for high speed printing comprising;

(a) mist production means to produce a mist from a liquid comprised substantially of water with a colourant incorporated therein such that the colourant is supported in the mist, (b) means to transport the mist in an arcuate path to a development station, (c) classification means to select mist droplets of a selected size range and to discard droplets above and below the selected size range, (d) means to transport a recording member having a latent electrostatic image thereon through the development station, (e) the means to transport the mist further transporting the mist of the selected size range across the recording member between the recording member and an adjacent development electrode such that its direction of travel is substantially parallel or tangential to the recording member, (f) means to apply an electric field between the development electrode and the recording member whereby the mist is attracted to the electrostatic image to instantaneously develop it, and (g) means to extract unused mist from the development station.

49. A method of developing a latent electrostatic image for high speed printing comprising the steps of;

(a) producing a mist from a liquid comprised substantially of water with a colourant incorporated therein such that the colourant is supported in the mist, (b) transporting the mist to a development station in an arcuate path, (c) classifying thre mist as it is transported to the development station to select mist droplets of a selected size range and to discard droplets above and below the selected size range, (d) passing the mist between a development electrode and a recording member having a surface incorporating the electrostatic image at the development station such that the direction of travel of the mist is substantially parallel or tangential to the surface of the recording member, (e) providing an electric field between the development electrode and the recording member, (f) attracting the mist by means of the electric field to the electrostatic image to instantaneously develop the electrostatic image, and (g) extracting the residual unused mist from the development station.

50. A method of developing an electrostatic image using a mist comprising substantially water with a colourant incorporated therein such that the colourant is supported in the mist including the step of classifying the mist into a selected droplet size range before development of the image.

51. An electrostatic image development arrangement for high speed printing including mist production means to produce a mist from a liquid comprised substantially of water with a colourant incorporated therein such that the colourant is supported in the mist and classification means to separate droplets from the mist which are above or below a selected size range before development of an electrostatic image.

* * * * *